US005404420A

United States Patent [19]

Song

[11] Patent Number: 5,404,420

[45] Date of Patent: Apr. 4, 1995

[54] COOKING OVEN USING FAR-INFRARED TUBE HEATER

[76] Inventor: Eugene Song, 209 Hanyang Apt, 42 Yoido Dong, Yung Dung Po-Ku, Seoul, Rep. of Korea

[21] Appl. No.: 104,212

[22] Filed: Aug. 10, 1993

[51] Int. Cl.[6] ..... A21B 2/00; F26B 19/00

[52] U.S. Cl. ..... 392/416; 219/411; 219/400

[58] Field of Search ..... 392/416, 418; 219/405, 219/411, 400, 401, 391, 392, 399; 99/483, 451, 467; 426/523, 241-243, 248

[56] References Cited

U.S. PATENT DOCUMENTS

| | | | |
|---|---|---|---|
| Re. 31,765 | 12/1984 | Guibert | 219/411 |
| 2,864,932 | 12/1958 | Forrer | 219/411 |
| 4,350,874 | 9/1982 | Nishikawa | 219/400 |
| 4,756,091 | 7/1988 | Van Denend | 219/405 |
| 4,817,509 | 4/1989 | Erickson | 219/400 |
| 4,870,255 | 9/1989 | Fujii et al. | 219/400 |
| 5,045,671 | 9/1991 | Kanaya et al. | 219/411 |
| 5,165,328 | 11/1992 | Erickson et al. | 219/400 |

FOREIGN PATENT DOCUMENTS

| | | | |
|---|---|---|---|
| 86421 | 8/1983 | European Pat. Off. | 219/400 |
| 319373 | 6/1989 | European Pat. Off. | 219/400 |
| 61-165525 | 7/1986 | Japan | 219/400 |
| 1-167975 | 7/1989 | Japan | 219/411 |
| 2-103315 | 4/1990 | Japan | 219/411 |
| 3-25225 | 2/1991 | Japan . | |
| 3-168521 | 7/1991 | Japan | 219/411 |
| 333410 | 8/1930 | United Kingdom | 219/400 |
| 1581127 | 10/1980 | United Kingdom | 392/435 |
| 2102561 | 2/1983 | United Kingdom | 219/400 |

*Primary Examiner*—Bruce A. Reynolds
*Assistant Examiner*—John A. Jeffery
*Attorney, Agent, or Firm*—Y. Judd Azulay

[57] ABSTRACT

A quick-cooking oven equipped with a far-infrared heating tube. Heat and far-infrared radiation are generated from ceramic heating tubes. A motor for rotating a cooling fan and the heating elements are completely shielded to prevent motor failure. The cooking space can be expanded by the use of expander rings. The fan does not get soiled, and there is no need for cleaning it, and the oven can be cleaned simply.

7 Claims, 9 Drawing Sheets

COOKING OVEN USING FAR-INFRARED TUBE HEATER

BACKGROUND OF THE INVENTION

Conventional domestic ovens, such as gas ranges and electrically heated ovens, are based on direct cooking. These ovens are bulky and costly for cooking a small amount of food, since they consume a large amount of power, which is a disadvantage. Recently, many combined ovens have been introduced. Among these is that disclosed in U.S. Pat. No. 4,350,874, in which there is described a cooking chamber formed of a case part and base part. The base part has a step-like wall inside which fits the case part; there is a heating chamber containing a heating element; and there is a hot-air fan in the heating chamber in order to transfer heat. There is also a cooling fan placed adjacent to the heating chamber. In this cooking oven, the hot-air fan cyclones the air into the cooking chamber at a high speed, in order to distribute the heat evenly onto the food. Thus, the thermal efficiency is quite low. Also, in order to cyclone the hot air, the hot-air fan must operate at a high speed, and the motor service life is short, which is problematic. Also, the hot-air fan is situated almost in-line with the top of the case part and, therefore, the cycloning hot air is directly in contact with the case part, where the temperature of the cooking chamber is high. Thus, during the retrieval of the cooked food, the hand may be burned.

In U.S. Pat. No. 4,817,509, there is disclosed a circular top, which has in its center an air fan. A heating element is placed over the fan. In this cooking oven, hot air is also cycloned into a cooking chamber by a hot-air fan, in order to distribute the hot air evenly onto the food being cooked. This oven also has a low thermal efficiency, and it requires a cooling means to cool the hot-air fan. Hence, the construction becomes complex, which is a disadvantage. More-over, the top of the upper part of this cooking oven, which is contacted by the hot air from the hot-air fan, is flat, and the lower part of the air-fan is almost situated on the same plane. Hence, the top of the upper part may be melted or the hand may be burned during the retrieval of the cooked food. The fan is located below the heating part, and is exposed to the cooking chamber; thus, the splashing of food onto the fan is inevitable, and, in order to clean it, the unit must be dismantled, which is inconvenient.

In U.S. Pat. No. 5,165,328, there is disclosed a cooking chamber that is formed by an upper sealing cylinder, and extension rim part, and a lower sealing cylinder. The unit also includes a cooking-chamber heating means, and an upper support part, as well as a hinged support assembly consisting of an extension part and a lower part. In this cooking oven, the hot air directly contacts the upper sealing cylinder, and the upper part may melt or the hand may be burned; in order to clean the exterior cooking vessel, the air fan must be detached, which is inconvenient. Also, the expander ring is a unitized object, and it is cumbersome to store and is damaged easily. Alternatively, an expander ring consists of two parts for alleviating such problems. The two parts are assembled, however, by aid of small clips, which can be lost when disassembled, and, in addition, the expander ring is cumbersome to assemble. In this cooking oven, the upper support part is attached onto the housing, so that these parts are inseparable, thus making cleaning difficult.

SUMMARY OF THE INVENTION

The present invention has obviated all of the above-described problems. The present invention utilizes a ceramic heating tube, and a fan is installed on top of the ceramic heating tube. A far-infrared beam is emitted from the ceramic heating tube by the heat generated in the ceramic heating tube, and directly infiltrates the food being cooked. The heat is distributed evenly in the food. The present invention is quite different from the conventional cooking oven, in which a hot-air stream is cycloned to the4e food so as to cook it; compared to the oven of the prior art, the oven of the invention requires only a short cooking time and has high thermal efficiency.

The present invention pertains to a cooking oven equipped with a far-infrared heating tube. Heat and a far-infrared beam are generated from a ceramic heating element. Thus, the thermal efficiency is increased and the cooking time is shortened. The motor and the heating element are completely shielded to prevent motor failure. The cooking space can be expanded by the use of expander rings. The fan does not get soiled, and there is no need for cleaning it, or the oven can be cleaned simply.

Another characteristic of the invention is that a low-speed fan is installed in the lower part of the heater base to heat the cooking chamber evenly and to prevent the splashing of grease or food matter onto the fan; thus, it is not necessary to dismantle the fan when cleaning.

Another characteristic of the invention is that the top surface of the hood is sloped, and the ceramic heating tube is placed on the upper part of the sloped wall. By installing the ceramic heating tube this way, the convected air stream does not contact the top of the hood, so that melting of the hood is prevented. Also, sufficient space is provided between the cover and the hood so that the hand is not burned when the handle is grabbed.

Another characteristic of the invention is that a mica sheet is inserted between the motor and the heating-element part to shield the heat from heating the motor, so as to prevent overheating of the motor, which prevents shortening of the motor's service-life.

Another characteristic of the invention is that according to the volume of food to be cooked, the volume of the cooking chamber can be enlarged by the use of expander rings having unique, separable attaching parts, in order to provide a very convenient manner of cooking.

Another characteristic of the invention is that a stand is provided, which is detachable, so that the cover can be opened while the unit is attached to the stand. Depending upon the purpose, the oven can be provided without the stand.

BRIEF DESCRIPTION OF THE DRAWINGS

The invention will be more readily understood with reference to the accompanying drawing, wherein.

DETAILED DESCRIPTION OF THE INVENTION

Figure 1:
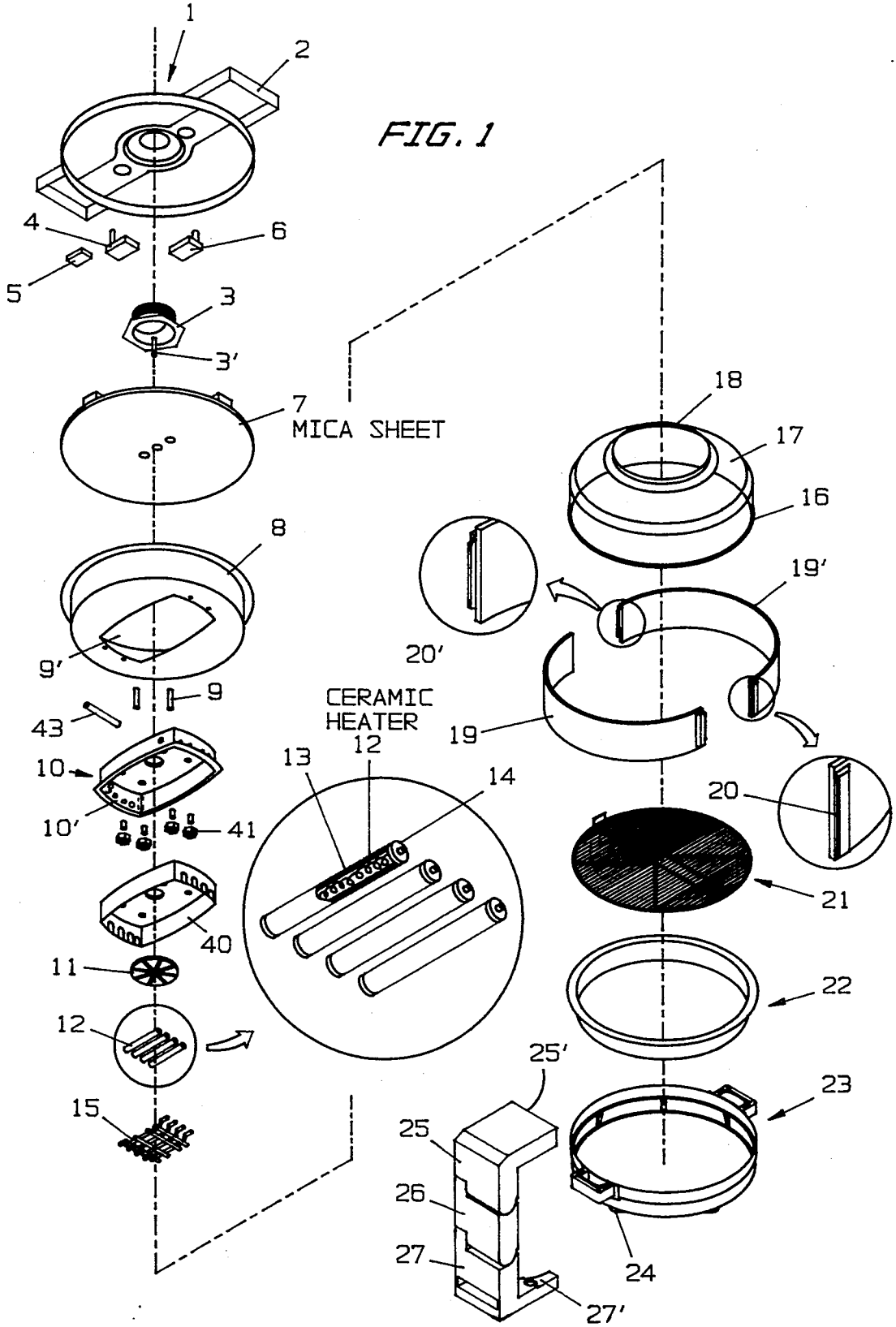
FIG. 1 is an assembly view, in perspective, of the cooking oven of the invention in its disassembled state.
Figure 3A:
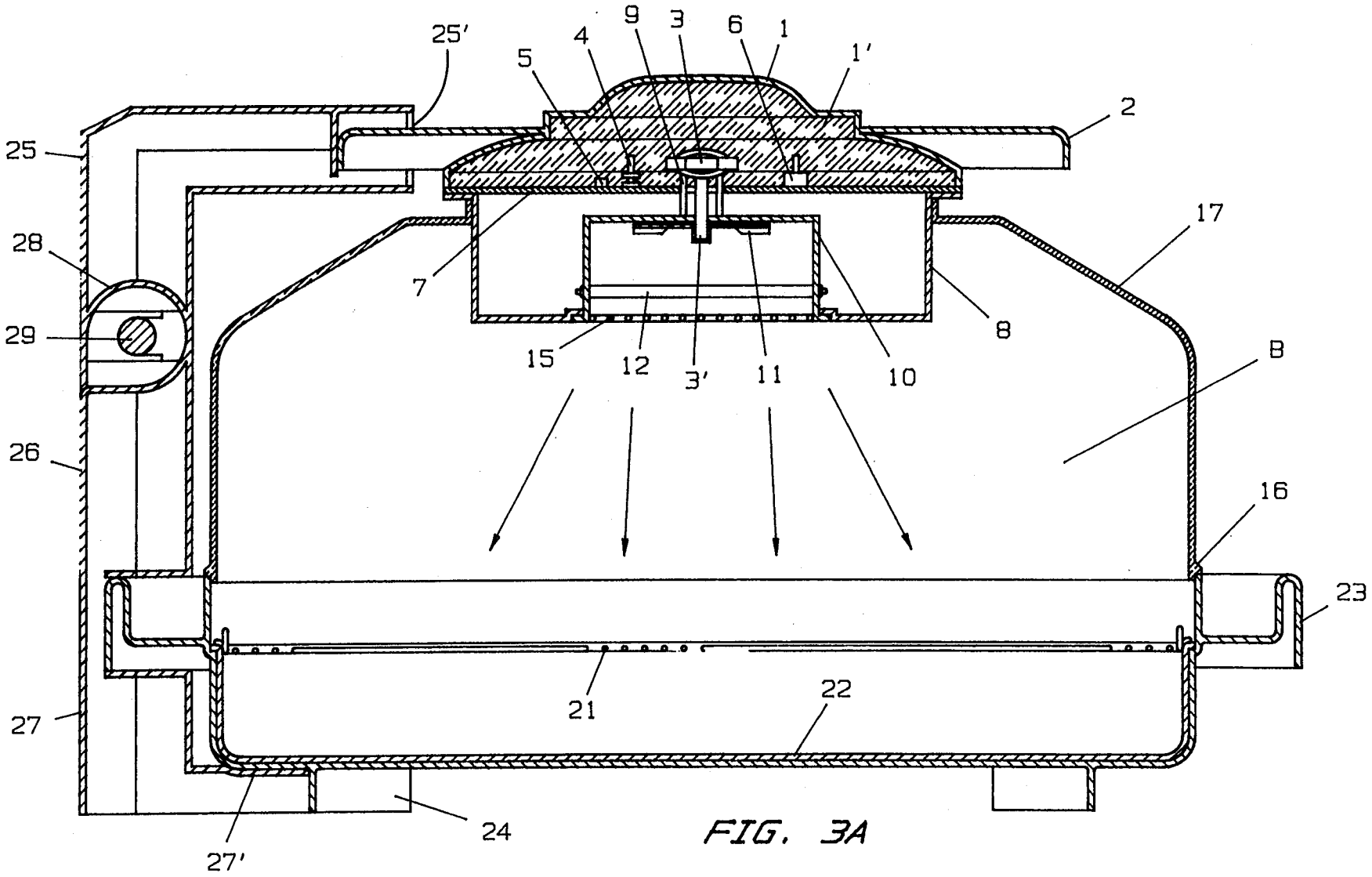
FIGS. 3A and 3B are cross sectional views thereof.
Figure 3B:
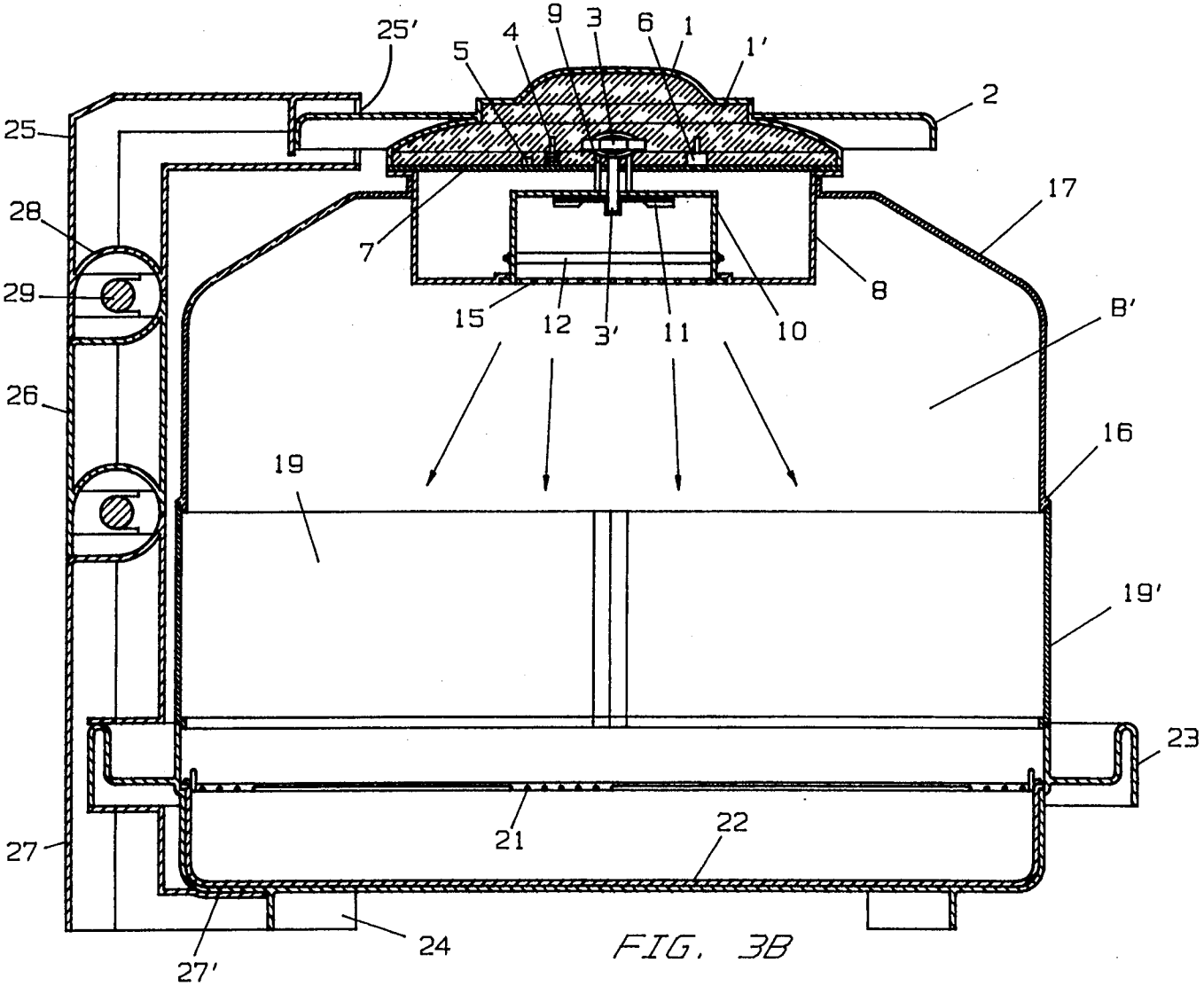
Figure 4:
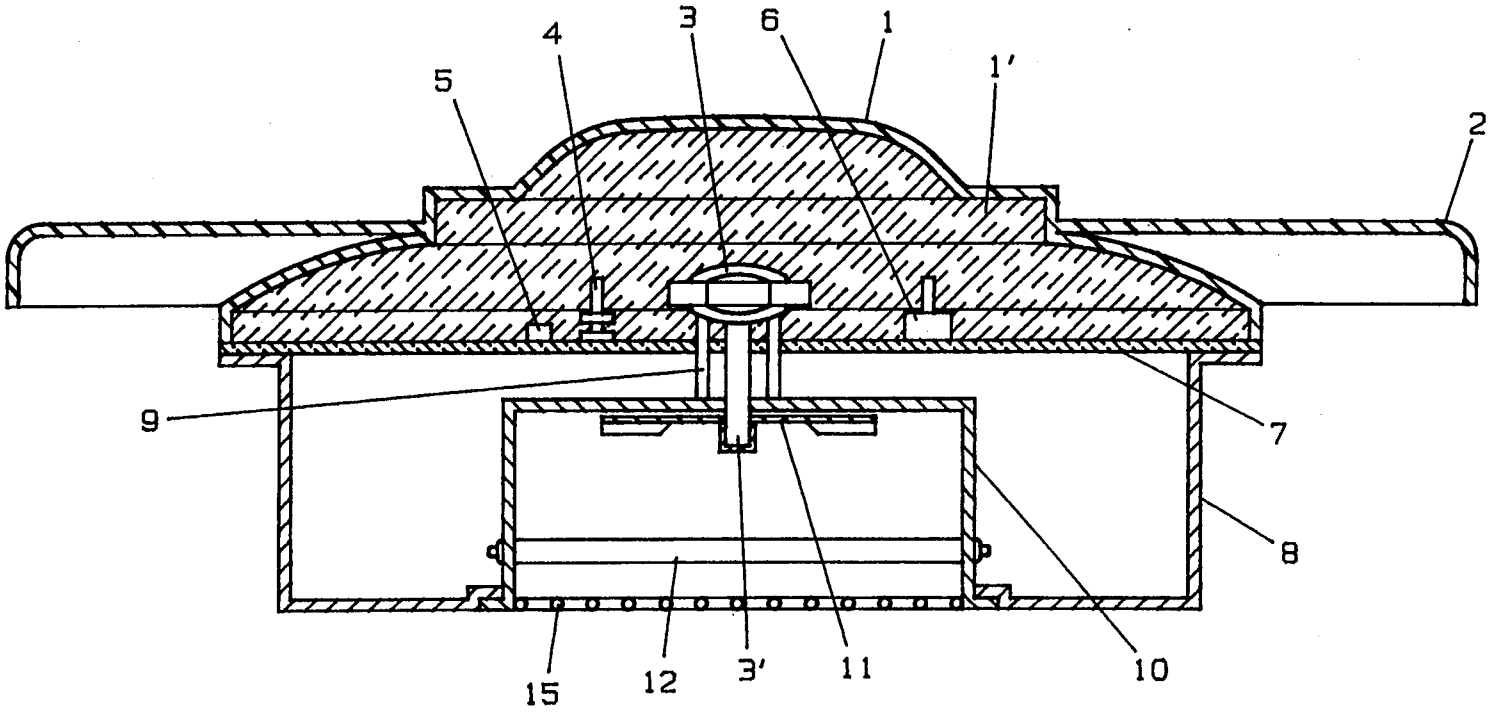
FIG. 4 is an enlarged view of the heat-generating part.
Figure 5:
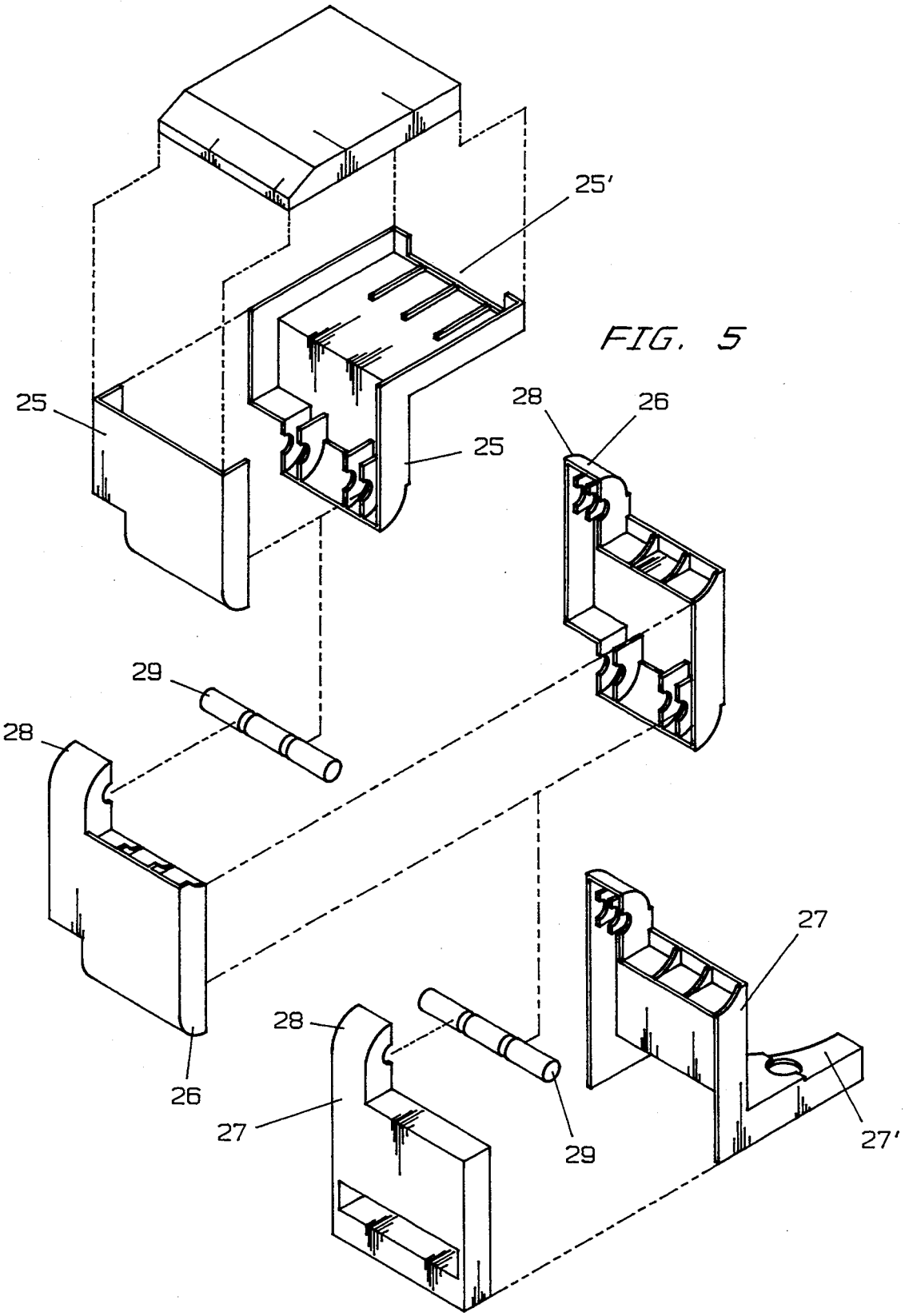
FIG. 5 is an assembly view, in perspective, showing the hinged, pivoting mechanism.
Figure 6A:
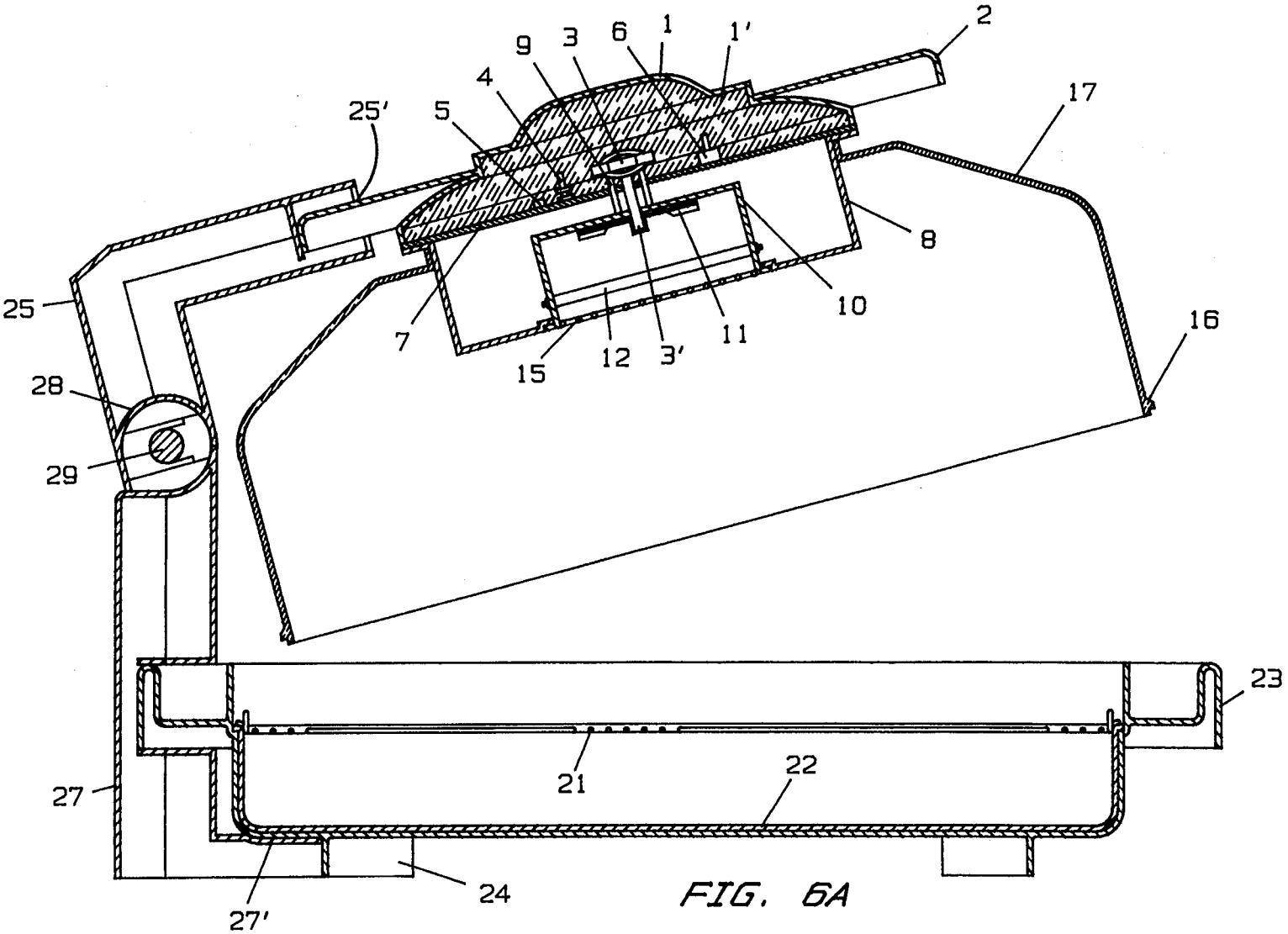
FIGS. 6A and 6B show the cover after being lifted.
Figure 6B:
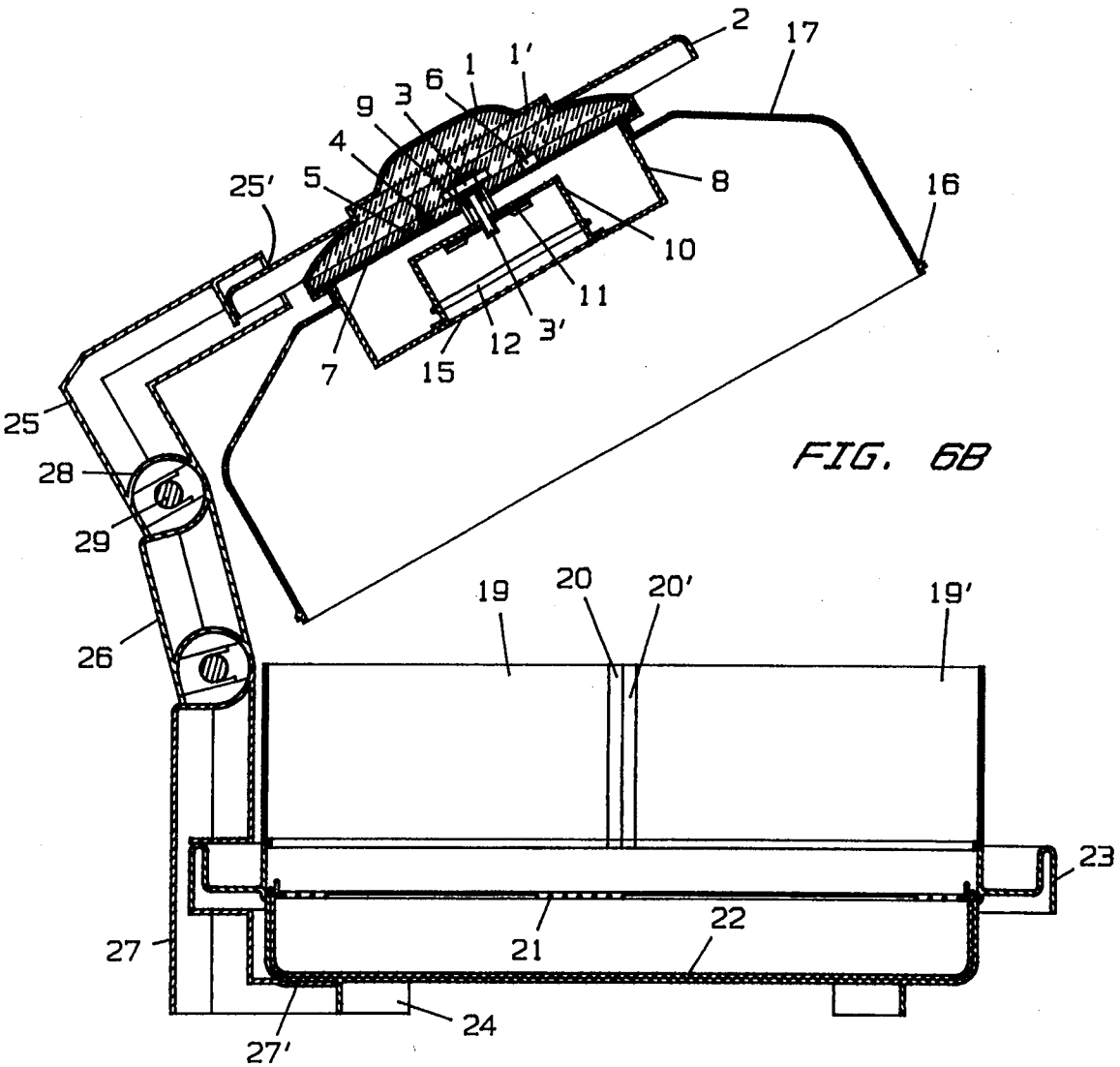
Figure 7:
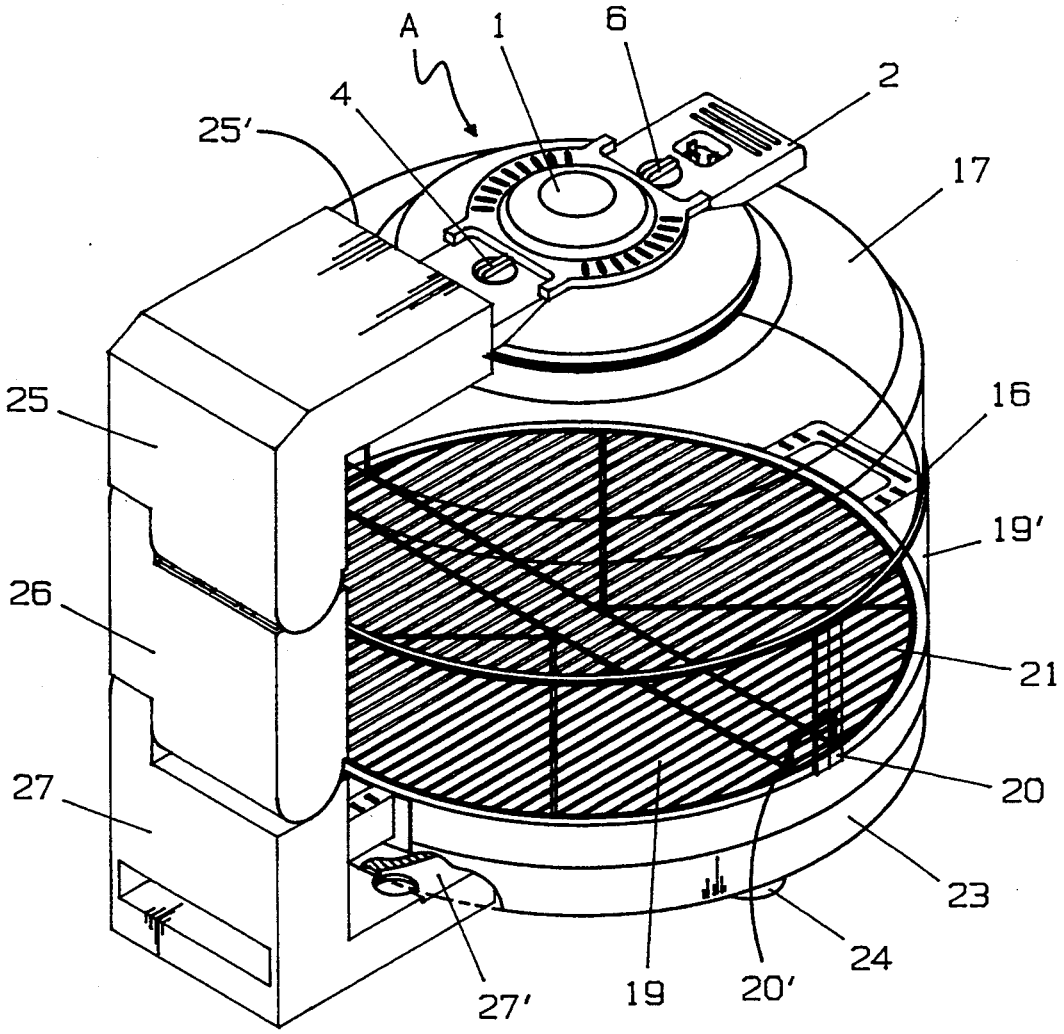
FIG. 7 shows the stand assembled.

Referring now to the drawing in greater detail, the oven has a cooking chamber B (FIG. 3A) with a cover assembly A (FIG. 7), a hood 16 and container 23. A heat-shielding mica sheet 7 is installed on a motor 3 which is emplaced in urethane 1'. Below mica sheet 7, there is installed a heater base 8 made of aluminum and having an insert hole 8', and space 9' is formed by the aid of spacers 9, and an attaching part 10 is attached. A fan 11 is secured onto the motor shaft 3'. Far-infrared, ceramic heating tubes 12 are inserted into inserting holes 10' located on both ends of attaching part 10, and a protective mesh screen 15 is installed, and a hood 16 is provided, which hood 16 has a sloped wall 17 attached to the heater base 8. An infrared-reflecting spreader 40 (See FIG. 1) is mounted between the upper the top of the attaching part 10 and the fan 11 by means of screw-nut assemblies 41. The spreader 41 ensures that all infrared radiation is reflected downwardly toward the cooking part of the over where the food is placed. The spreader-reflector 40 thus prevents the insulating mica sheet 7 from overheating, and, in practice, can lower the temperature of the mica sheet from 160 degrees C. to 110 degrees C. A pair of expander rings 19, 19' is provided, which will be fitted in between storage container 23 and hood 16. Each expander ring has a female, insert-hole piece 20 and a male insert-lug 20', and the rings are fitted or held in the stand 25. A lower stand-portion 27 has snapping part 27' (FIGS. 1 and 5) and a connecting stand-portion 26. The stands are hingedly-connected together. Mating grooves are formed on the container and mating ridges are formed on the opposite side; by using the pair of extension rings and by mating each counterpart, mating grooves and ridges, the space between the cover and container is expanded.

Figure 2:
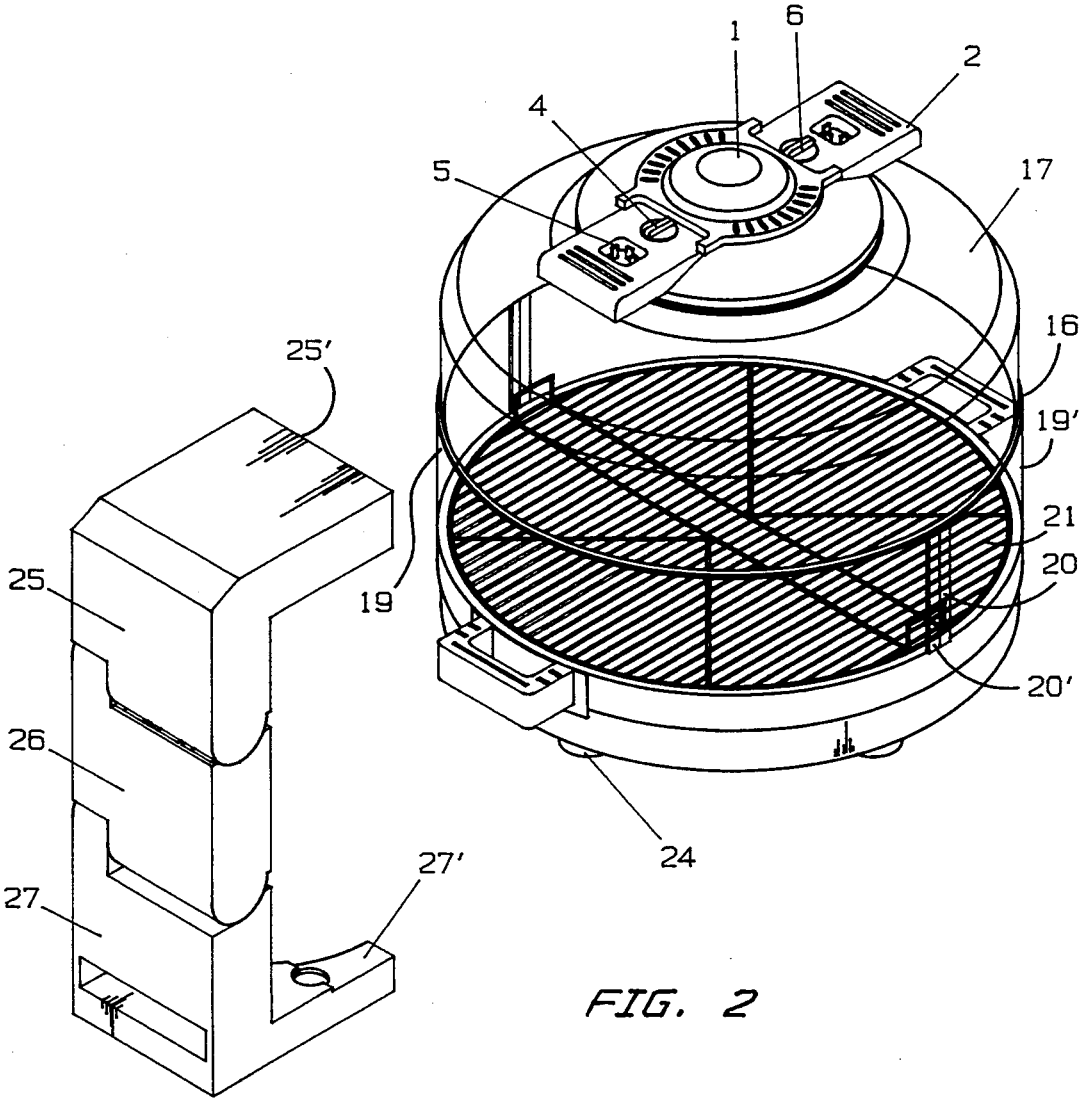
FIG. 2 is a perspective view of the cooking oven of the invention in its assembled state.

A frying pan 22 is placed in the container 23, and grill 21 is inserted. Hood 16 is then placed over frying pan 22 onto container 23. The cover assembly A is inserted into hood 16, and cover 1 is turned clockwise by which the electrical power is connected via receptacle 5 (FIG. 2.) The power heats heating wire 13 in ceramic heating tubes 12 connected via bushings 14. The heat from the heated wires of the ceramic heating tubes 12 is blown by fan 11 into the cooking chamber B. The fan's speed is preferably 2,400 rpm, and is made of aluminum in order to block the infrared beams and to reflect them back down toward the cooking chamber, and they also prevent heat conduction to protect the motor. Since the heater base 8 is also made of aluminum, all of the infrared beams will eventually be reflected back down toward the cooking chamber. At the same time, far-infrared beams are generated from the ceramic heating tubes 12, which penetrate through the food, by which the food can be cooked in a short time. Compared with the conventional cyclone-type heating oven, the temperature is low and the thermal efficiency is high. Each wire in each ceramic tube is preferably 0.5 mm. in diameter, and draws less than 800 watts. The outer diameter of the ceramic tube itself is preferably 13 mm., whereby an interior container volume of 360 cubic centimeters may be heated to 200 degrees C. within a period of two minutes and thirty seconds when three such tubes 12 are used. As a comparison, a 2.5 kg. whole chicken may be cooked in 12–15 minutes by the oven of the invention, as compared to 40 minutes by a conventional oven.

The far-infrared ceramic tubes 12 used in the invention are commercially available, and produce a long wave band of infrared radiation from 2.7 to 10 microns. For 2,7 micron radiation, the temperature achieved is 750 degrees C.; for 10.0 radiation, the temperature achieved is 300 degrees C. However, the use of such infrared tubes has not been for cooking foods or for use in an oven, as in the present invention. Each ceramic tube has an interior, electrical wire, which, when conducting electricity, heats up. This heat causes the outer, ceramic casing to give off far-infrared beams, which are used, according to the invention, for cooking food. While most of the cooking of the oven of the invention is achieved by the infrared beams, the heat generated by the electrical coils in the ceramic tubes 12 are also utilized in order to speed up the cooking process. Thus, the fan 11 provides the forced air currents to force this heat of convection to the food being cooked. Thus, the fan helps to cook the food faster by forcing the heat generated by the wires toward the food, as well as reflecting back the infrared beams impinging thereon, while the fan also protects the motor from the heat generated in the oven, since it is made of aluminum. Using aluminum is important in order to reflect the infrared beams back to the cooking chamber. Generally, a far-infrared radiation tube has a very short service life, when used at high temperatures. Thus, it has not hitherto been used in cooking applications. In the present invention, however, the fan 11 allows the heat conducted on the outer ceramic tubing to be dissipated, which heat may reach 1000 degrees C. This eliminates the disadvantages and the short-service life of the conventional far-infrared radiation tube in high-temperature applications.

When the temperature of the cooking chamber B reaches a pre-set temperature, heated by ceramic heating tubes 12, then the thermostat 6 will shut off the power. The thermostat 6 senses the air temperature in the interior of the oven, and not a surface temperature, so that a greater degree of heating and cooking ensues, which would otherwise not be the case if a metal surface, or the like, were sensed. The fan 11 operates in order to heat the cooking chamber B by simple convection heating.

When cooking food, the frying pan 22, during cooking, will collect grease and other food matter, while the food will be on the grill 21 above; hence, the bottom of the food will be heated by the hot air, so as to be cooked in even a shorter time. The ceramic heating tubes 12 are located at the bottom plane of the sloped wall 17 of the hood 16. Thus, the far-infrared beams will be radiated along straight lines 19 onto the food, and hood 16 will not melt, since the infrared beams are not directed toward the hood but directly onto the food therebelow. In addition, when grabbing handle 2 on cover 1, there is enough space so that the hand will not touch the hot hood 16 because of sloping wall 17.

The motor 3 is completely isolated by mica sheet 7 and urethane 1' from the ceramic heating tubes 12, and air-gap or space 9' of 2.5 mm. is formed between the motor 3 and attaching part 10 by separating plates 9. Thus, the heat will not be transferred directly to the motor 3, whereby the motor 3 is protected. The mica sheet 7 also has mounted thereto a temperature regulator 7'. The regulator 7' will cause the automatic shut off of power if the temperature of the mica sheet 7 reaches 140 degrees C. Thus, whereas the thermostat 6 only sense the air temperature, the regulator senses a surface, whereby faster and more efficient cooking may take place.

When cooking is terminated after a given cooking period, which is set by timer 14, the cooking state can be observed through transparent cover 1 and the food can be taken out. In cleaning the cooking oven, container 23, hood 16, and cover assembly A are disassembled and cleaned. Because fan 11 is located above the ceramic heating tubes 12, and protected by the mesh 15, by which splashing is prevented, it is, therefore, unnecessary to separate the heater base 8 and the fan 11. Cleaning is achieved simply without disassembly.

When the food is bulky, then the cooking chamber B may be expanded by the use of expander rings 19, 19' after first forming each ring by snapping insert-lug 20' into the insert-hole piece 20. The ring is then inserted between container 23 and hood 16 to form an expanded cooking chamber B', and it is very convenient. Expander rings 19, 19' can be disassembled and assembled easily; hence, they are easily removed and stored when not in use. After cleaning, while cooking, or after cooking, it may be necessary to keep hood 16 open, and, then, connecting stand 26 can be utilized to adjust the height. The handle 2 will be inserted in hole 25' on upper stand 25, and foot 24 on the container 23 will be snapped into snapping part 27' on lower stand 27, and then hood 16 can be lifted by pivoting at pivot 29, while moving simultaneously with upper stand 25 and connecting stand 26. In this manner, the hood 16 can be opened without occupying extra space for the hood 16. Therefore, it can be used regardless of the size of the working space, and the stand can be utilized conveniently, and there are no cumbersome operations.

As described above, the heat and the far-infrared beams are radiated from the ceramic tubes 12, and the far-infrared beams will penetrate into the food and heat it evenly. Thus, the thermal efficiency is increased, and the cooking time is shortened. The electrical wires of all of the infrared ceramic tubes use only 1200 watts of power. Moreover, the motor 3 and the heat generating part are completely separated, and, thus, the service life of the motor is extended. Furthermore, by the use of the expander rings 19, 19', which are easy to assembly and disassemble, the cooking chamber B can be enlarged, but also the fan will not be soiled, or it can be cleaned without dismantling it.

The invention has the advantages in that the food is cooked thoroughly and rapidly by direct irradiation by the far-infrared beams, and, due to the absence of swirling, high-speed air-motion, the inside walls of the container, and especially the part around the heating tubes, will not be soiled or blackened by oil, juice, etc. of the cooked food. Moreover, the hood of the oven is not contacted by hot air-streams, so that its external temperature reaches only about 90 degrees C., which is about 30% lower than that of existing, convection-type ovens. Power consumption during cooking is about 30% less than the conventional, convection, high-speed air ovens, because of the use of infrared beams for cooking, while the initial temperature rise is about twice as fast, whereby from a initial, cold state to an interior temperature of 200 degrees C., only 2½ minutes is required. In addition, the flavor of the cooked food is enhanced with cooking by infrared radiation.

While a specific embodiment of the invention has been shown and described, it is to be understood that numerous changes and modifications may be made therein without departing from the scope, spirit and intent of the invention as set forth in the appended claims.

What I claim is:

1. An oven for cooking food, comprising:

a lower, cooking chamber;

an upper, heating chamber operatively associated with said lower, cooking chamber;

said upper cooking chamber comprising heating means for producing infrared beams directed toward said lower, cooking chamber for cooking food therein; said upper, heating chamber comprising cooling means being mounted above said infrared heating means for directly cooling said heating means, and power means for providing electrical power to said coil;

said cooling means comprising a motor, and a fan driven by said motor; said upper, heating chamber further comprising an upper mounting lip, and a casing for mounting said heating means and said fan therein; said motor being mounted above said casing and having a drive shaft extending into said casing and operatively coupled to said fan; said casing having an upper wall having an opening for the passage therethrough of said drive-shaft; said upper, heating chamber further comprising a top cover-portion mounting said motor therein, said top cover-portion being mounted on said upper mounting lip, said top cover-portion having solid, insulating material substantially filling the interior thereof, said motor being embedded in said solid, insulating material for protecting said motor from excessive heat.

2. The oven for cooking food according to claim 1, wherein said heating means comprises a plurality of infrared-beam generating tubes.

3. The oven for cooking food according to claim 2, wherein each of said plurality of infrared-beam generating tubes comprises a ceramic housing, and an electrical resistance coil mounted in said ceramic housing said coil is powered, said ceramic housing is heated to give; said cooling means cooling all of said plurality of infrared-beam generating tubes.

4. The oven for cooking food according to claim 1, said top cover-portion further comprising an insulating bottom sheet forming the bottom thereof and by which said top cover-portion is supported on said upper mounting lip; said sheet having an opening for passing therethrough said drive-shaft.

5. The oven for cooking food according to claim 4, wherein said upper, heating chamber further comprises spacing means for aiding in the mounting of said motor for spacing said motor from the upper wall of said casing, in order to shield said motor from high heat; said sheet having at least one hole for passing therethrough said spacing means.

6. An oven for cooking food, comprising:

a lower, cooking chamber;

an upper, heating chamber operatively associated with said lower, cooking chamber;

said upper cooking chamber comprising heating means for producing heat directed toward said lower, cooking chamber for cooking food therein;

said upper, heating chamber comprising cooling means for cooling said heating means, and power means for providing electrical power to said heating means; said upper, heating chamber further comprising a casing for mounting said heating means and said fan therein; said motor being mounted above said casing and having a drive shaft extending into said casing and operatively coupled to said fan; said casing having an upper wall having an opening for the passage therethrough of said drive-shaft; said upper, heating chamber having spacing means for mounting said motor for spacing said motor from said upper wall of said casing, in order to shield said motor from high heat;

said upper, heating chamber further comprising solid, insulating material, said motor being embedded in said solid, insulating material for protecting said motor from excessive heat, and a mica sheet below said motor for additional insulation.

7. In an quick-cooking, lower-power oven for cooking food comprising:

a lower, cooking chamber;

an upper, heating chamber operatively associated with said lower, cooking chamber;

said upper cooking chamber comprising heating means for producing heat for cooking food positioned in said lower cooking chamber;

said upper cooking chamber further comprising a cooling fan, and a motor for rotating said cooling fan, wherein the improvement comprises:

an expansion ring for selective, removable positioning between said upper chamber and said lower chamber for expanding the interior volume of said oven; said expansion ring comprising a first, arcuate half-section having a first end and a second end, and a second, arcuate half-section also having a first end and a second end; one of said first and second ends of said first half-section having one of a projecting male-member and a receiving female-receptacle, and the other of said first and second ends of said first half-section also having one of a projecting male-member and a receiving female-receptacle; one of said first and second ends of said second half-section having one of a projecting male-member and a receiving female-receptacle, and the other of said first and second ends of said second half-section also having one of a projecting male-member and a receiving female-receptacle, whereby said two half-sections may be removably secured together by mating male and female ends.

* * * * *